US005377966A

United States Patent [19]

Ohmori

[11] Patent Number: 5,377,966

[45] Date of Patent: Jan. 3, 1995

[54] AUTOMATIC DOCUMENT FEEDER

[75] Inventor: Masaki Ohmori, Yamanashi, Japan

[73] Assignee: Nisca Corporation, Yamanashi, Japan

[21] Appl. No.: 85,081

[22] Filed: Jul. 2, 1993

[30] Foreign Application Priority Data

Jul. 3, 1992 [JP] Japan ..... 4-200293

[51] Int. Cl.[6] ..... B65H 1/06; B65H 31/20

[52] U.S. Cl. ..... 271/3; 271/223

[58] Field of Search ..... 271/3, 3.1, 171, 209, 271/223, 291

[56] References Cited

U.S. PATENT DOCUMENTS

| | | | |
|---|---|---|---|
| 4,023,791 | 5/1977 | Hori et al. . | |
| 4,279,504 | 7/1981 | Brown | 271/3.1 X |
| 4,846,456 | 7/1989 | Sakai | 271/3.1 |
| 5,026,044 | 6/1991 | Ryon et al. . | |
| 5,201,505 | 4/1993 | Shah | 271/3 |

FOREIGN PATENT DOCUMENTS

| | | | |
|---|---|---|---|
| 55-98762 | 7/1980 | Japan . | |
| 59-114249 | 7/1984 | Japan . | |
| 60657 | 1/1985 | Japan . | |
| 181631 | 7/1989 | Japan | 271/3 |
| 3120125 | 5/1991 | Japan . | |

*Primary Examiner*—Richard A. Schacher

*Attorney, Agent, or Firm*—Oblon, Spivak, McClelland, Maier, & Neustadt

[57] ABSTRACT

A compact automatic document feeder having a document storage portion including a document tray for placing thereon given original documents to be fed into an image processing device such as a copying machine, and a document receiving device disposed on the document tray. The document receiving device comprises document holding members movable widthwise for holding the document to be fed into the image processing device, and document supporting members for receiving the document discharged from the image processing device is adapted to effectively divide the document stacked on the document tray and the discharged document independently, so as to prevent the document being discharged from colliding with the document left on the document tray.

13 Claims, 7 Drawing Sheets

AUTOMATIC DOCUMENT FEEDER

BACKGROUND OF THE INVENTION

1. Field of the Invention

This invention relates to an automatic document feeder for automatically feeding given original documents one by one to the image reading station of an image processing device such as a copying machine and printer, and more particularly, to a compact and simple document feeder having a common document tray for placing thereon one or more original documents to be fed into the image processing device and receiving the documents sent out from the image processing device.

2. Description of the Prior Art

For coping with a need for downsizing image processing devices such as a copying machine, facsimile, image scanner, and printer, the latest automatic document feeders mounted on the image processing devices tend to be made compact without degrading the performance in handling and transporting the given original document. The copying machine typical of the image processing device generally has a transparent platen on which an image reading station is defined and one given original document is placed for being optically scanned to read an image on the document. On the platen, there is mounted the document feeder for automatically feeding and sending out the given original document to and from the image reading station defined on the platen.

The automatic document feeder usually comprises a document feeding tray for placing thereon the original documents to be fed hereafter one by one to the image reading station on the platen, and a document discharging tray for receiving the original documents sent out from the image reading station upon completion of image processing. For directly transporting the document to and from the image reading station, a document transporting unit is built into the document feeder and overlaid on the platen.

It has been so far attempted to place the document feeding tray and document discharging tray one upon another in order to reduce the area occupied by the document feeder. One illustrative instance of the document feeders of this kind is disclosed in U.S. Pat. No. 4,023,791 (corresp. to Japanese Pat. Publication No. SHO 60-657(B2).

In the document feeder proposed by said U.S. Patent, the document feeding tray is independently placed on and displaced horizontally from the document discharging tray to facilitate the removal of the discharged original documents from the document discharging tray, resulting in a large overall size of the document feeder. Furthermore, the proposed document feeder is likely to entail a disadvantage such that, when the document to be fed has the habit such as curvature, the leading end of the document sent out from the image processing device to the document discharging tray by the document transporting unit after image processing is possibly caught by the bottom of the document feeding tray.

A document feeder proposed by Japanese Patent Application Public Disclosure No. HEI 3-120125(A) has a document tray for placing a stack of original documents thereon. In this proposed feeder, the documents stacked on the document tray are drawn one by one and fed to an image reading station and sent back from the image reading station onto the top of the stack of documents left on the document tray in a U-turn. The documents sent back from the image reading station and the stack of documents still left on the document tray are divided by a pair of document receiving members. The document being discharged from the image processing station moves in the opposite direction to the direction in which the document left on the document tray is sent into the image reading station, while coming in sliding contact with the document stacked on the document tray from the leading end toward the tail end of the document. When discharging the document from the image reading station onto the unfed documents stacked on the document tray, there is a possibility that the leading end of the discharged document collides with the leading end of the the stack of documents left on the document tray, thus causing the discharged document to be obstructed by the stack of documents left on the document tray.

A document feeder of different type has been proposed, which has a common document tray serving as a document feeding tray for feeding documents to be fed to the image reading station in a copying machine and a document discharging tray for receiving the documents sent out from the image reading station. For instance, a recycling automatic document feeder (generally called "recycle-ADF") for circulating several times a plurality of original documents through a transporting passage including the image reading station to obtain a plurality of sets of copies is disclosed in Japanese Patent Application Public Disclosures Nos. SHO 55-98762(A) and SHO. 59-114249(A).

The document tray in the conventional recycle-ADF is formed by merely combining the document feeding tray and document discharging tray, so that the documents sent out from the image reading station of the copying machine each time the image processing is completed are put on the top of the unfed documents stacked on the document tray. To count the number of the circulation of the documents being subjected to image processing, a cycle counting lever is interposed between the documents to be fed to the image reading station and the discharged documents sent out from the image reading station.

In the conventional ADF described above, since the documents still left on the tray to be read and the discharged documents sent out from the image reading station are divided only by the simple counting lever, but not independently separated from each other, the discharged document possibly collides with the unfed documents stacked on the document tray, thus developing feeding trouble and causing the discharged documents to be out of order. This disadvantage becomes particularly conspicuous when the original documents different in size are dealt with.

If a partition member is used to prevent the unfed documents stacked on the document tray to be read from interfering with the advancing of the document discharged from the image reading station, the handling work of getting the documents in and out relative to the document tray becomes onerous.

OBJECT OF THE INVENTION

This invention is made to eliminate the drawbacks suffered by the conventional document feeders as described above and has an object to provide a convenient automatic document feeder having a common document tray capable of infallibly feeding unfed original documents to be dealt with one by one to the image reading station of an image processing device and receiving the documents sent out from the image reading station without colliding with the aforesaid unfed document to be dealt with upon completion of image processing.

Another object of this invention is to provide an automatic document feeder which is made compact and simple by integrating a document feeding tray for placing and feeding one or more original documents one by one to the image reading station with a document discharging tray for receiving the documents discharged from the image reading station, with a structure capable of definitely dividing the documents to be dealt with and the discharged documents, so as to prevent the leading end of the discharged documents from colliding with the unfed document left on the document tray.

Still another object of this invention is to provide an automatic document feeder capable of easily placing and removing original documents on and from a document storage portion and effectively dealing with various documents even different in size.

Yet another object of this invention is to provide an automatic document feeder which can be applied to a variety of image processing devices such as a copying machine, printer, facsimile and image scanner and all sorts of devices to which a sheet material is required to be automatically fed, and capable of manually placing and removing an original document onto and from the image processing devices at need.

SUMMARY OF THE INVENTION

To attain the objects described above according to this invention, there is provided an automatic document feeder comprising a document tray for placing thereon one or more original documents to be fed, a document transporting means having a document feeding part for transferring the documents one by one to an image reading station of an image processing device and a document discharging part for sending out the document from the image reading station, and document receiving means having a pair of document holding members standing upright on the document tray and a pair of document supporting members attached to the respective document holding members for receiving the document sent out from the image reading station.

At least one of the document holding members is movable so as to true up the side edges of the documents stacked on the document tray.

Close to the discharge port formed in the document discharging part of the document transporting means, a curing member is formed on the document tray for allowing the document discharged from the discharge port to be maintained flat so as not to cause the leading end of the discharged document to collide with the tail end of the stack of documents on the document tray.

The document feeder is mounted on an image processing device such as a copying machine in such a state that the image reading station defined on the image processing device is overlaid with the document transporting means.

The document supporting members extending horizontally from the upper ends of the document holding means have concave notches defining a wide opening through which the documents can easily be placed on the document tray.

The document tray is provided with at least one pivoted guide piece which elastically protrudes upward in a normal state and is retractable under the upper surface of the document tray when one or more documents are put thereon. In the state that the pivoted guide piece protrudes upward, when the given document lacks firmness and is bent downward when being discharged from the discharge port, the leading end of the document being discharged collides with the guide piece, thus leading the document discharged from the image reading station is no longer hindered in its forward movement by the tail end of the unfed document stacked on the document tray.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

This invention will become more fully understood from the detailed description given hereinbelow and the accompanying drawings which are given by way illustration only, and thus are not limitative of the present invention.

The automatic document feeder according to this invention is applicable to image processing devices of all types of requiring to automatically feed one or more given original documents to be dealt with, such as a copying machine, printer, facsimile and image scanner. In The illustrative embodiments described hereinafter, the automatic document feeder of this invention is applied to the copying machine by way of example.

Figure 1:
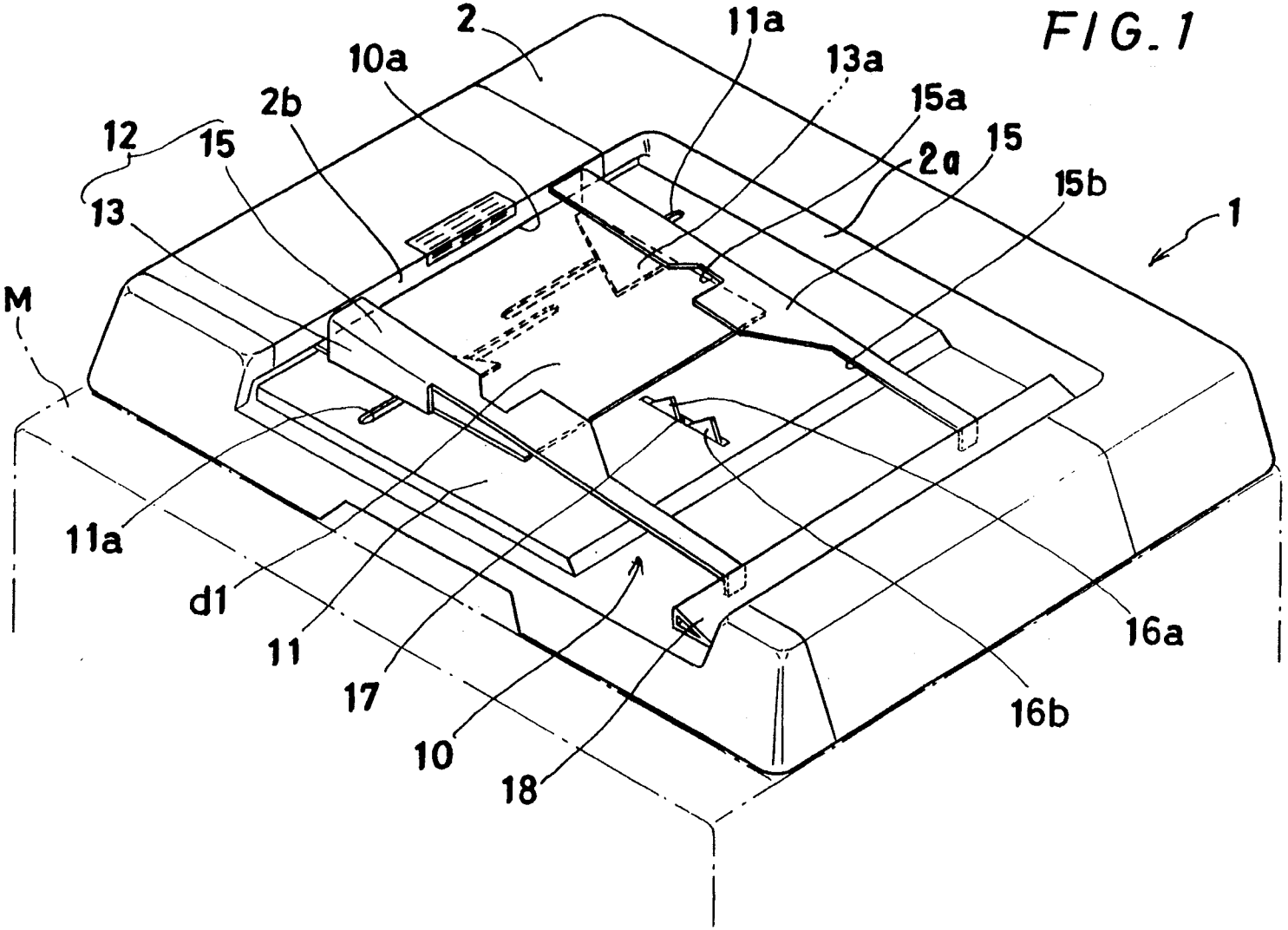
FIG. 1 is a perspective view showing a first embodiment of an automatic document feeder according to this invention.
Figure 3:
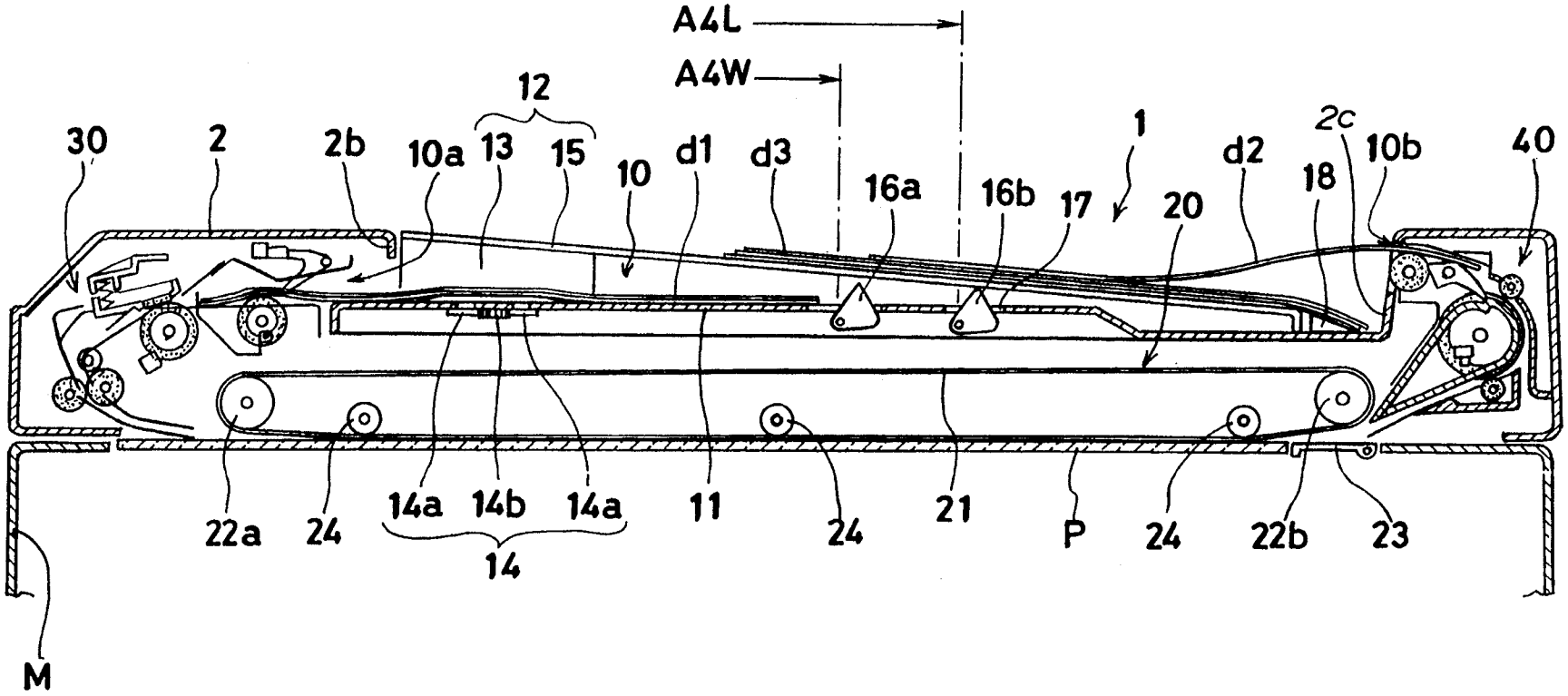
FIG. 3 is a side sectional view of the same feeder.

The automatic document feeder 1 of this invention is mounted on the copying machine M as illustrated in FIGS. 1 and 3. The image processing device (copying machine M) of this kind generally comprises an image reading mechanism having a transparent platen P on which an image reading station RS is defined for optically scanning the image surface of the given original document placed thereon.

The document feeder 1 is pivotally fixed at one side edge thereof on the copying machine M by hinge means (not shown), so as to be lifted up rotatably about the hinge means to open the image reading station RS.

The document feeder 1 principally includes a housing 2 having a document storage portion 10 formed in a concave shape, and a document transporting means 20 disposed within the housing 2.

The document storage portion 10 in this embodiment is defined by at least one side wall 2*a*, a front wall 2*b* and a rear wall 2*c* of the housing 2. The front wall 2*b* has a document intake port 10*a*, and the rear wall 2*c* has a document discharge port 10*b*. The bottom of the document storage portion 10 is substantially on a level with the lower edge of the document intake port 10*a* to form a document tray 11 on which one or more original documents d1 to be subjected to image processing are placed.

On the document tray 11 is disposed a document receiving means 12 comprising a pair of document holding members 13 standing upright, and a pair of document supporting members 15 extending horizontally from the respective upper ends of the document holding members 13. The document holding members 13 have document keeping plates 13*a* extending in the direction facing to each other.

In this embodiment, the document receiving means 12 consisting of the document holding members 13 and document supporting members 15 is slidably movable widthwise along guide slits 11a formed in the document tray 11 and extending in parallel in the width direction of the document d1 placed on the document tray 11, so as to vary the distance between the holding members 13 in accordance with the width of the document d1 placed between the holding members 13. Thus, the stack of documents d1 to be fed to the image reading station RS can be securely held with the side edges being turned up by the document holding members 13.

Figure 4:
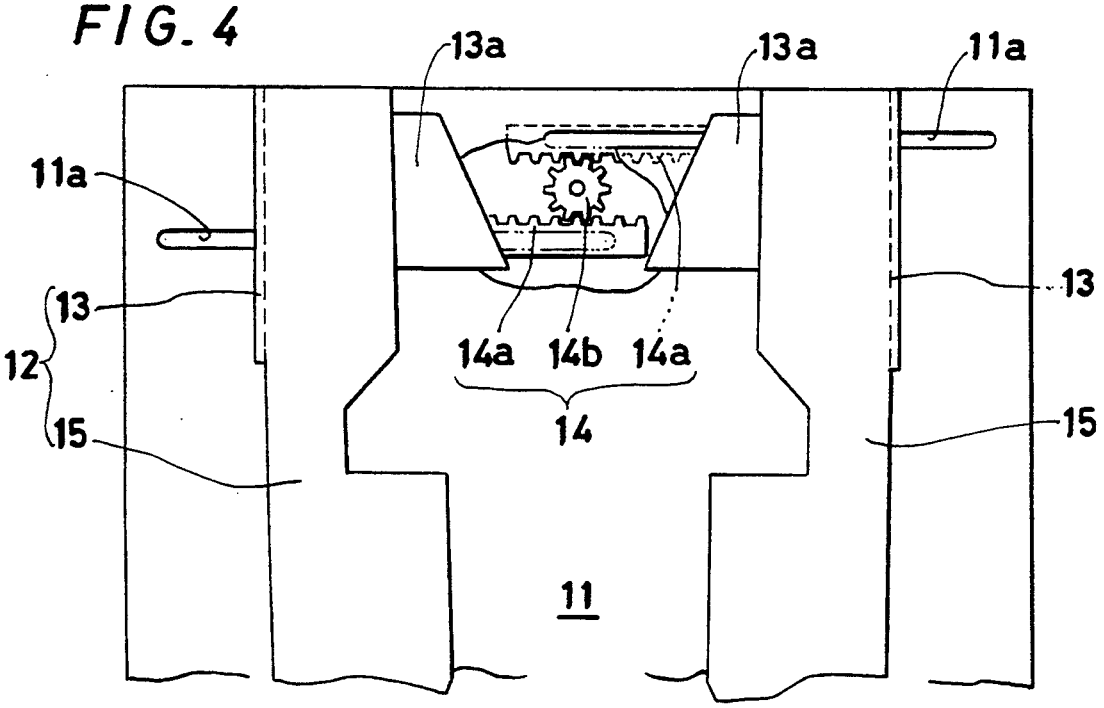
FIG. 4 is a plan view of a parallel moving mechanism for document holding means of this invention.

For moving the paired document receiving means 12 in opposite directions to vary the distance therebetween, there may be used a parallel moving mechanism 14 comprising racks 14*a* attached to the respective document keeping plates 13*a* through the slits 11*a* and a pinion 14*b* located between the racks 14*a*, as illustrated in FIG. 4 as one example. With this parallel moving mechanism 14, by moving one of the paired document holding members 13 in one direction, the other holding member 13 is moved in the opposite direction at a time. Thus, the distance between the document holding members 13 can vary without changing the center between the holding members 13.

Though both the document holding members 13 are moved in opposite directions at a time in this embodiment, only one of the document holding members 13 may be made movable. In this case, for example, the side wall 2*a* defining the document storage portion 10 in conjunction with the front and rear walls 2*b* and 2*c* may be used as the other stationary document holding member, and it is sufficient to form only one guide slit 11*a*.

The parallel moving mechanism for transmitting the movement of one of the document holding members 13 to the other document holding member 13 can be otherwise composed of towing belts or an endless towing belt passed around wheels secured rotatably on the document tray and connected to the document holding members 13.

To facilitate the placing of the given documents d1 to be dealt with onto the document tray 11, the opposed inside edge portions of the document supporting members 15 are partially cut to form concave notches 15*a* and 15*b* for defining wide openings through which the documents can be passed and placed on the document tray 11 with ease. By forming the concave notches 15*a* and 15*b* in the document supporting members 15, the paired document holding members 13 need not open to the extent equal to the width of the given document, because the document can be passed through the opening formed by the opposed concave notches 15*a* or 15*b*. Therefore, it is desirable to determine the depth of each concave notch according to the width of the document of high frequency in use.

Each of the document supporting members 15 slantingly extends substantially from the upper edge of the document intake port 10*a* formed in the front wall 2*b* toward the lower edge of the document discharge port 10*b* formed in the rear wall 2*c*. The document sent out via the discharge port 10*b* moves forward with its side portions coming into face contact with the upper surface of the document supporting members 15 as indicated by d2 in FIG. 2, and finally rests on the document supporting members 15 above the document tray 11 as indicated by d3.

There is a case that the document d2 discharged from and through the document discharge port 10*b* is bent downward in the width direction, causing the middle portion thereof to be near the document tray 11, when the given document is made of a relatively wide and thin sheet of paper and lacks firmness. In such a case, there is a possibility that the leading end of the discharged document d2 collides with the rear end of the stack of documents d1 still left on the document tray 11, thus causing the trouble of discharging the document.

Figure 5:
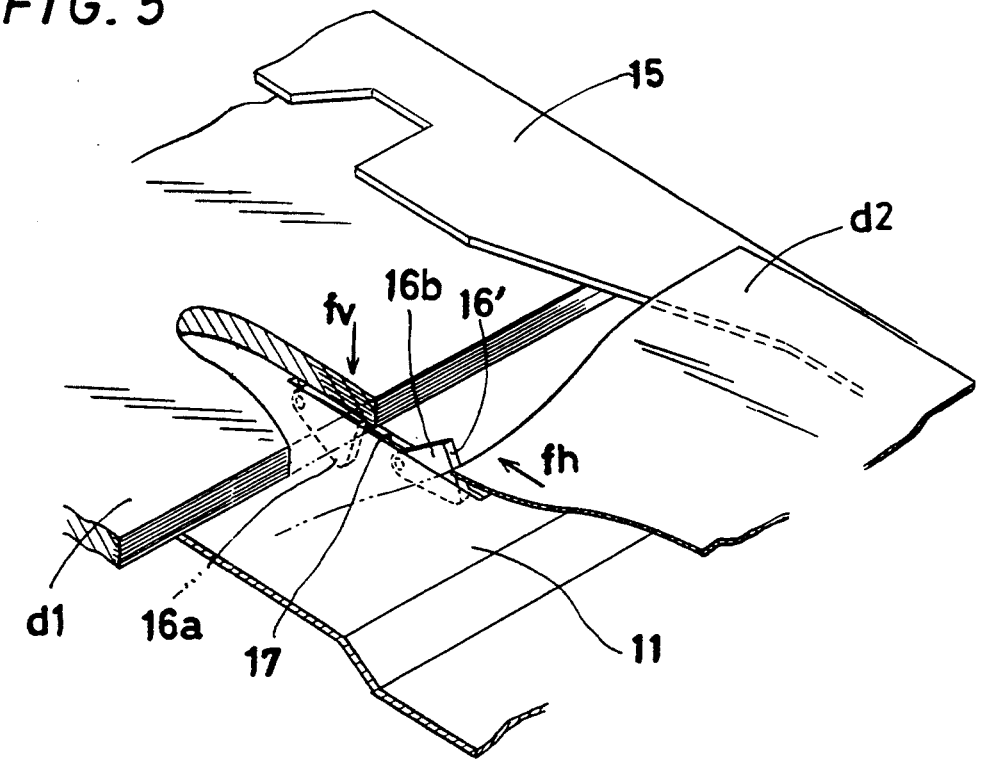
FIG. 5 is a perspective view, partially in section, of document guide pieces of this invention.

To remedy the drawback noted above, the document tray 11 is provided with guide pieces 16*a* and 16*b* to discharge the documents successfully. As illustrated in FIG. 5, each of the guide pieces 16*a* and 16*b* is formed of a triangular plate and pivoted at its one corner on the document tray 11, so that they elastically protrude upward in a normal state through a hole 17 (i.e. guide piece 16*b* in FIG. 5), and are retracted under the upper surface of the document tray 11 when one or more documents are put thereon (i.e. guide piece 16*a* in FIG. 5). One side of each of the triangular guide pieces 16*a* and 16*b*, which faces the document discharge port 10*b*, inclines to form a sliding slope 16' so as to lead upwardly the document d2 discharged from the document discharge port 10*b*.

The guide pieces 16*a* and 16*b* pivoted on the document tray 11 cannot withstand the vertical force fv brought about by the weight of the documents, thus withdrawing downward under the document tray 11, but can withstand the horizontal force fh brought about by the document moving forward. Accordingly, in the state that the pivoted guide piece protrudes upward, when the document being discharged from the discharge port 10*b* lacks firmness and is bent downward, the leading end of the document collides with the sliding slope 16' of the guide piece, thus leading the document upwardly. As a result, the document is no longer hindered in its forward movement by the tail end of the document stacked on the document tray 11.

Though this embodiment is illustrated as using two guide pieces 16*a* and 16*b*, the number of such guide pieces is not specifically limited. Only a single guide piece or three or more guide pieces may be used selectively. When two guide pieces are used as in this embodiment, they may be preferably arranged in accordance with the length of the document of high frequency in use as illustrated. For example, the first guide piece 16*a* is located at distance A4W from the document intake port 10*a* which corresponds to the width of a sheet of A4 size (297 mm×210 mm), and the second guide piece 16*b* is located at distance A4L from the document intake port 10*a* which corresponds to the length of the A4 size sheet.

Though each guide piece is made of a triangular plastic plate in this embodiment, the shape and material of the guide piece are by no means limitative. For instance, the guide piece may be formed by bending a metallic wire in an L-shape.

Close to the document discharge port 10*b* formed at the rear end of the document tray 11, a curing member 18 is disposed on the document tray 11. This curing member 18 serves to allow the document d2 discharged from the discharge port 10*b* to be maintained flat, so as not to cause the leading end of the discharged document d2 to collide with the tail end of the stack of documents d1 left on the document tray 11. Though the curing member 18 in this embodiment has a triangular section having an inclined upper surface, this should be not understood as limitative. The upper surface of the curing member 18 may be of course made flat horizontally, or otherwise, the curing member may be formed by upwardly bending the surface of the document tray 11 in a step shape.

The document transporting means 20 comprises at least one endless belt 21 supported between driving pulleys 22*a* and 22*b* and coming into face contact with the platen P of the copying machine M to define the image reading station RS, a document feed part 30 for sending the documents d1 stacked on the document tray 11 one by one from the document intake port 10*a* to the image reading station RS defined between the endless belt 21 and the platen P through a feed passage R1, and a document discharging part 40 for transporting the document from the image reading station RS to the document discharge port 10*b* through a discharge passage R2.

The feed passage R1 is curved in a substantially U-shape, so that the document is turned upside down when being fed from the document tray 11 to the image reading station RS. Also, the discharge passage R2 is formed in a substantially U-shape, so that the document is turned upside down when being sent out from the image reading station RS onto the document receiving means 12 through the discharge port 10*b*.

When giving copying instructions to the copying machine M, the document feeder 1 is operated to draw out one of the original documents d1 stacked on the document tray 11 into the feed passage R1 through the document intake port 10*a* and further send the document into the image reading station RS. After copying, the document is transported from the image reading station RS to the discharge port 10*b* through the discharge passage R2 and further sent out onto the document receiving means 12.

At the exit of the image reading station RS defined between the endless belt 21 and the platen P, a document stopper 23 is disposed. When the given document d1 is sent into the image reading station RS through the feed passage R1, the stopper 23 rises to impede the forward movement of the document, so that the leading end of the document collides with the stopper 23 to bring the document to a stop at the prescribed position in the image reading station RS. When the copying is completed, the stopper 23 sinks to allow the document to pass over the stopper 23.

In FIG. 3, reference numeral 24 denotes pressure rollers for resiliently pressing the endless belt 21 against the platen P.

Figure 6:
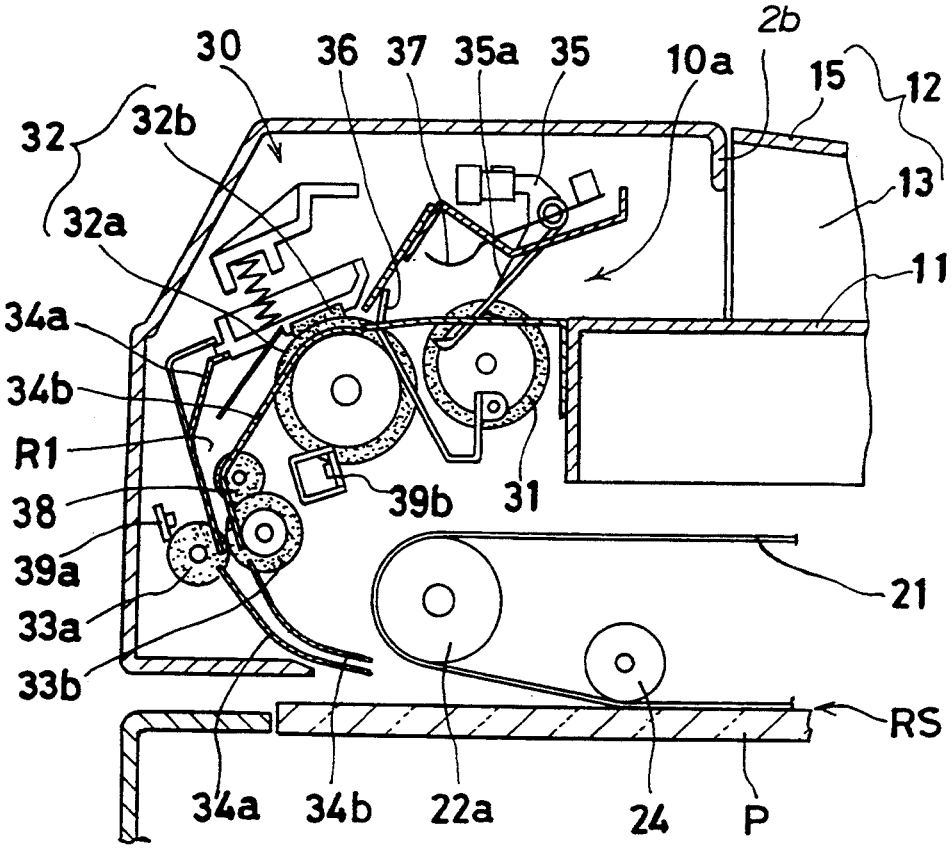
FIG. 6 is a side sectional view of a document feeding part of this invention.

The document feeding part 30 includes at least one pickup roller 31 for sending out the lowermost document of the documents d1 stacked on the document tray 11 to the feed passage R1, a separation means 32 composed of at least one set of separation roller 32*a* and separation pad 32*b* coming in frictional contact with the separation roller 32*a* for allowing only one document to pass therethrough, and at least one set of register rollers 33*a* and 33*b* for correcting the inclination of the document sent out from the document tray. The pickup roller 51, separation means 32, and register rollers 33*a*, 33*b* are arranged along the feed passage R1 as shown in FIG. 6.

The register rollers 33*a* and 33*b* do not rotate until the document sent from the document tray 11 through the separation means 32 collides with the nip portion at which the register rollers 33*a* and 33*b* come in press contact with each other. Immediately after the document collides with the nip portion between the register rollers, the register rollers start to rotate to allow the document to pass therethrough.

Even if the document is forwarded slantwise, the leading end of the document entirely comes in touch with the nip portion between the register rollers, when colliding with the nip portion. As a result, the document moves straightforwardly through the register rollers in the direction parallel to the document transporting direction.

Opposite to the pickup roller 31, an empty sensor 35 is placed for detecting the presence of the document d1 on the document tray.

Between the pickup roller 31 and the separation means 32, there is disposed a stopper gate 36 which is moved downward to permit the document d1 on the document tray 11 to pass therethrough upon receiving an operation signal from the copying machine M.

In FIG. 6, reference numeral 37 denotes a weight lever for urging the documents d1 against the document tray numeral 38 denotes an idle roller, and 39*a* and 39*b* denote a light emitting element and a photodetector for detecting the document passing therebetween.

Figure 7:
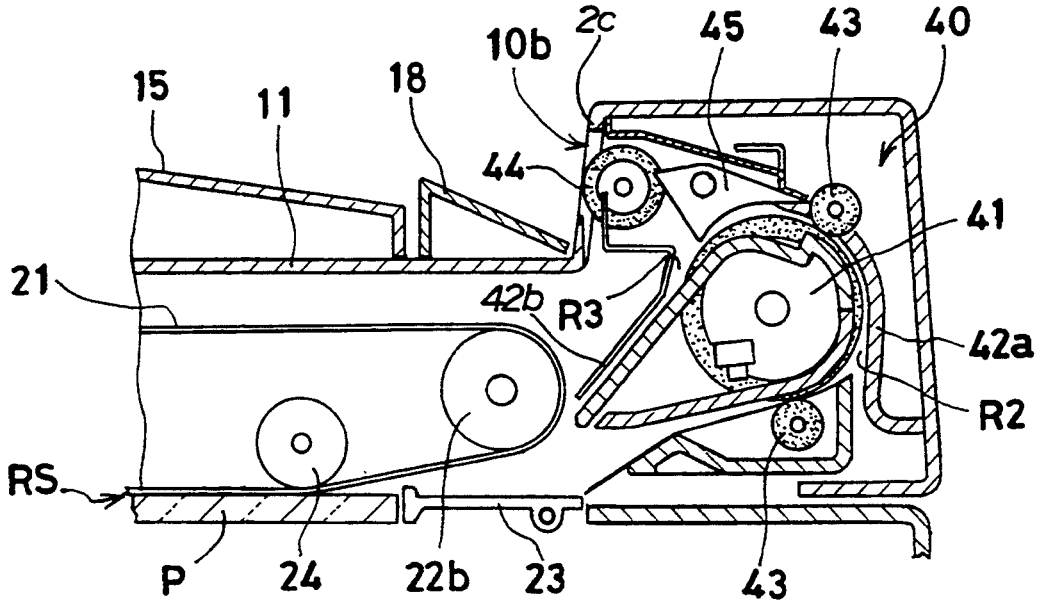
FIG. 7 is a side sectional view of a document discharging part of this invention.

The document discharging part 40 includes a turn-over roller 41 of a large diameter, and guide rollers 43 as illustrated in FIG. 7. Opposite to the turn-over roller 41, a guide plate 42*a* is arranged to define the aforesaid discharge passage R2, and another guide plate 42*b* is arranged to define a turn-over passage R3. Reference numeral 44 denotes a discharge roller. A switching lever 45 is disposed at the junction of the discharge passage R2 and the turn-over passage R3. In the normal state, the switching lever 45 permits the discharge passage R2 to communicate with the discharge port 10*b*. When effecting duplex copying, the switching lever is operated to close the path to the discharge port 10*b* and connect discharge passage R2 and turn-over passage R3. Thus, in the case of duplex copying, after copying one side of the document, the document printed on its both sides is first sent back, being turned upside down, to the image reading station RS through the discharge passage R2 and turn-over passage R3. Then, after copying the reverse of the document, the document is discharged from the image reading station RS through the discharge passage R2 and the discharge port 10*b*.

The document transporting means 20 including the endless belt 21, document feeding part 30 and document discharging part 40 is not specifically limited to the illustrated structure, but it may be chosen from the conventional document transporting means of various types for this invention.

The operation and function of the document feeder noted above according to this invention will be described hereinafter.

In placing one or more given original documents d1 be dealt with on the document tray 11, the document receiving means 13 are first opened to permit the documents d1 to pass into the document tray 11. The documents d1 may be passed through the opening formed by the opposed concave notches 15*a* or 15*b* formed in document supporting members 15 as occasion demands. Then, the documents d1 are inserted into the document intake port 10*a* until the leading end of the sheaf of documents touches the stopper gate 36 in the document feeding part 30. The documents d1 thus placed on the document tray 11 are securely held by closing the document holding means 13 to true up the side edge of the stack of documents d1 as shown in FIG. 1.

When the tail end portion of the stack of documents d1 is placed on the guide piece 15*a* or 15*b*, the guide piece is retracted downward in the document tray 11.

Figure 2:
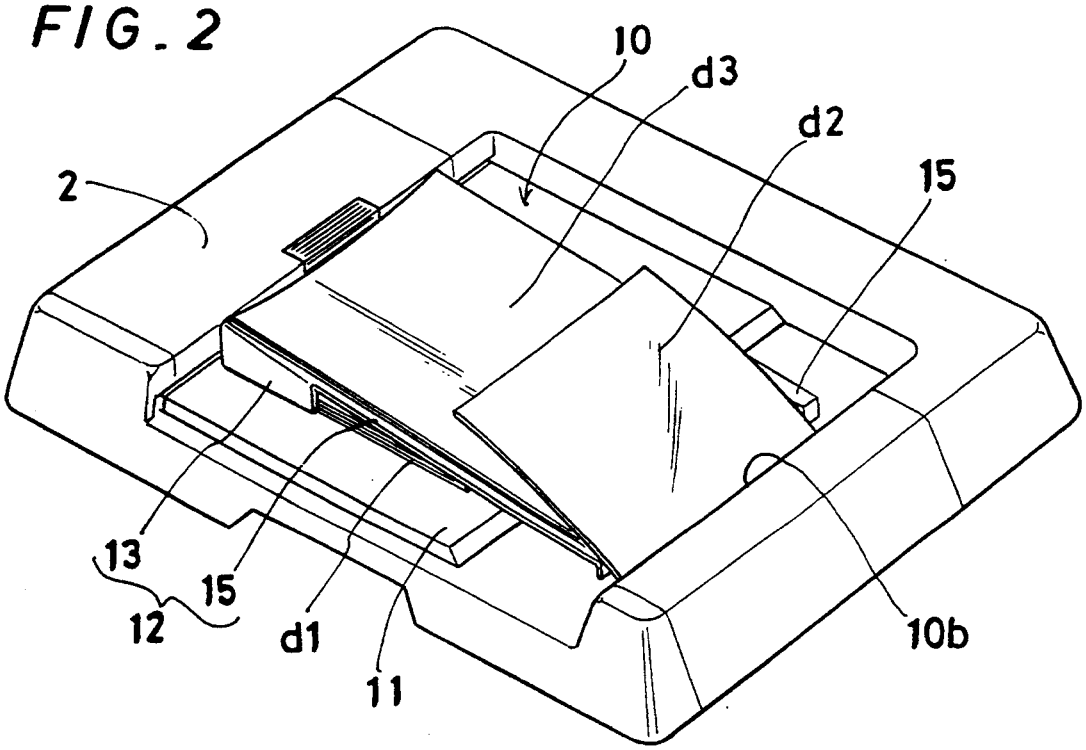
FIG. 2 is a perspective view of the same feeder, showing the state of discharging an original document.

At the time of given copying instructions to the copying machine M, the document feeding part 30 starts to operate so that one of the documents d1 is drawn out from the document tray 11 and transported to the image reading station RS defined on the platen P through the feed passage R1. Upon completion of copying, the document transporting means 20 and document discharging part 40 are driven to send out the document from the image reading station RS through the discharge passage R2 and discharge the document d2 onto the document receiving means 12 through the discharge port 10*b* as shown in FIG. 2.

When the first document of the stack of documents d1 on the document tray 11 is sent to and discharged from the image reading station RS, the central portion of the document being discharged from the discharge port 10*b* weighed down to a certain degree while being held at both sides by the document supporting members 15. In a case of dealing with the document lacking firmness, the central portion of the document which is weighed down possibly comes in touch with the surface of the document tray 11. Even if the document moves forward touching the document tray, the document is advantageously led upward specifically by the guide piece 16*b* as shown in FIG. 5.

Even when the document of a rigid sheet is used and moves forward over the guide piece 16*b*, it may be guided by the guide piece 16*a*. Thus, in any event, the document d2 discharged from the discharge port 10*b* can be properly placed in position on the document receiving means 12 without thrusting into neither colliding with the stack of documents d1 left on the document tray 11. The tail end portion of the discharged document is not supported by the document receiving means 12, but placed on the curing means 18 and maintained flat horizontally, so as not to cause obstruction to passage of the subsequent document discharged from the discharge port 10*b*.

The remaining documents d1 stacked on the document tray 11 are successively transported and overlaid on the first document resting on the document receiving means 12 one after another.

To prevent the discharged document advancing forward along the upper surface of the document receiving means 12 from intruding into the document intake port 10*a* through a gap between the front wall 2*b* of the housing 2 and the front end of the document receiving means 12, it is desirable to rather increase the height of the front wall 2*b* of the housing 2.

As described above, according to the automatic document feeder of this invention, the space on the document tray can be commonly applied for stacking the documents to be dealt with and receiving the documents discharged from the image processing device, as a result which the document feeder can be made compact with improving its space factor and operation efficiency. Besides, the given original documents can be effectively transported without interfering between the documents stacked on the document tray and the document coming back from the image reading station.

Figure 8:
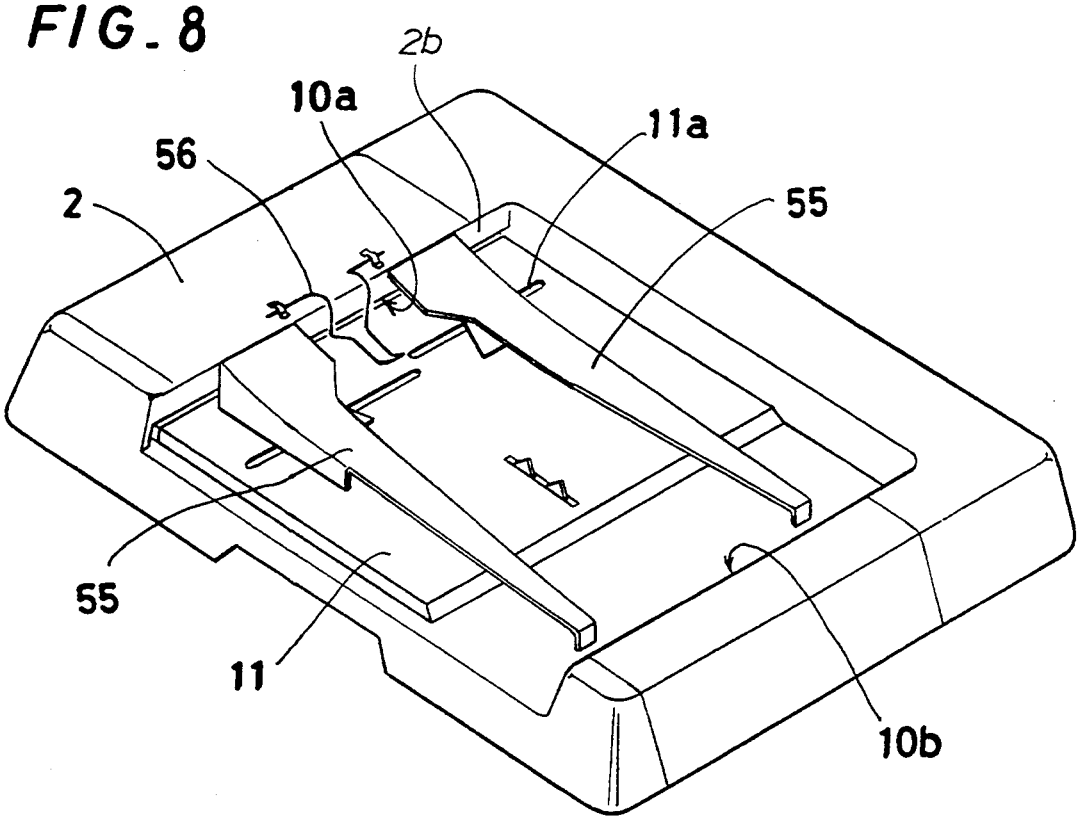
FIG. 8 is a perspective view of a second embodiment of this invention.

The concave notches 15*a* and 15*b* formed in the document supporting members 15 on which the discharged document is placed are not absolutely necessary to this invention. As shown in FIG. 8, the document supporting members 55 may be formed in a shape tapered off toward the discharge port 10*b*. In the embodiment shown in FIG. 8, the reference numerals which have equivalents in the diagrams of the foregoing embodiment mentioned above denote identical or equal component parts. The description of these component parts is omitted below to avoid repetition.

The embodiment of FIG. 8 includes a guide member 56 having a free end inclined upward toward the discharge port 10*b* so as to facilitate insertion of the documents into the intake port 10*a*. The guide member 56 is made of a steel wire or the like and hinged on the housing 2 so that it can be turned out upward.

The guide member 56 has functions of not only facilitating the insertion of the documents into the intake port 10*a*, but also preventing the original document being discharged from the discharge port 10*b* from entering into between the front wall 2*b* and the front end of the document receiving means 12.

Figure 9:
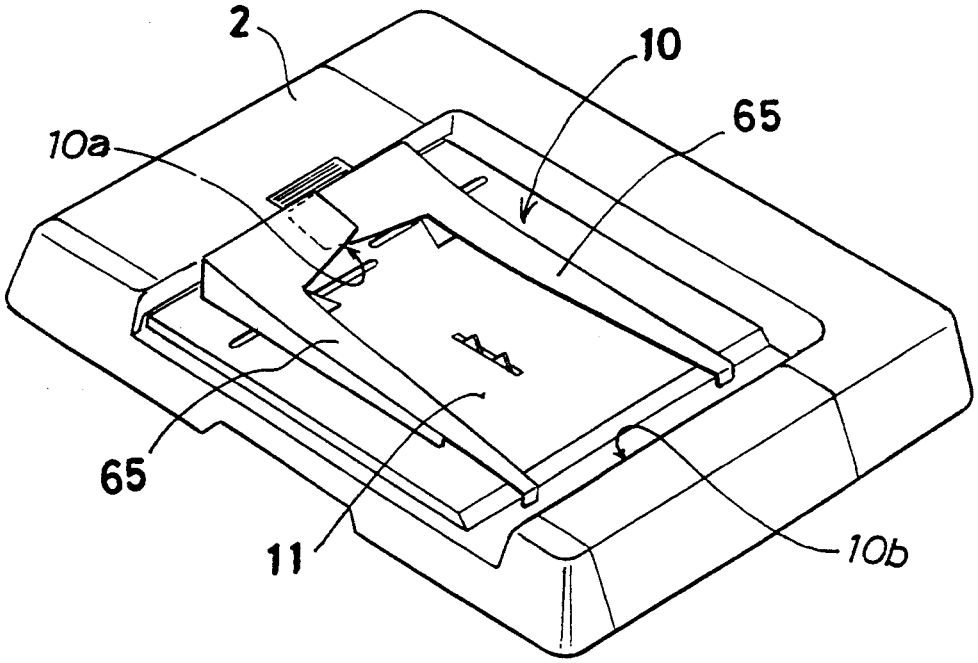
FIG. 9 is a perspective view of a third embodiment of this invention.

In the third embodiment shown in FIG. 9, document supporting members 65 of paired document receiving means are each formed of a substantially L-shaped plate and partially overlap with each other on the side of the intake port 10*a*. The front end portions of the document supporting members 65 near the intake port 10*a* are made higher than the upper surface of the housing 2, so that the document being discharged from the discharge port 10*b* is prevented from intruding into the intake port 10*a* through between the front wall and the front end of the document supporting members 65. The identical or similar components of this embodiment are denoted by the same numerical symbols.

Figure 10:
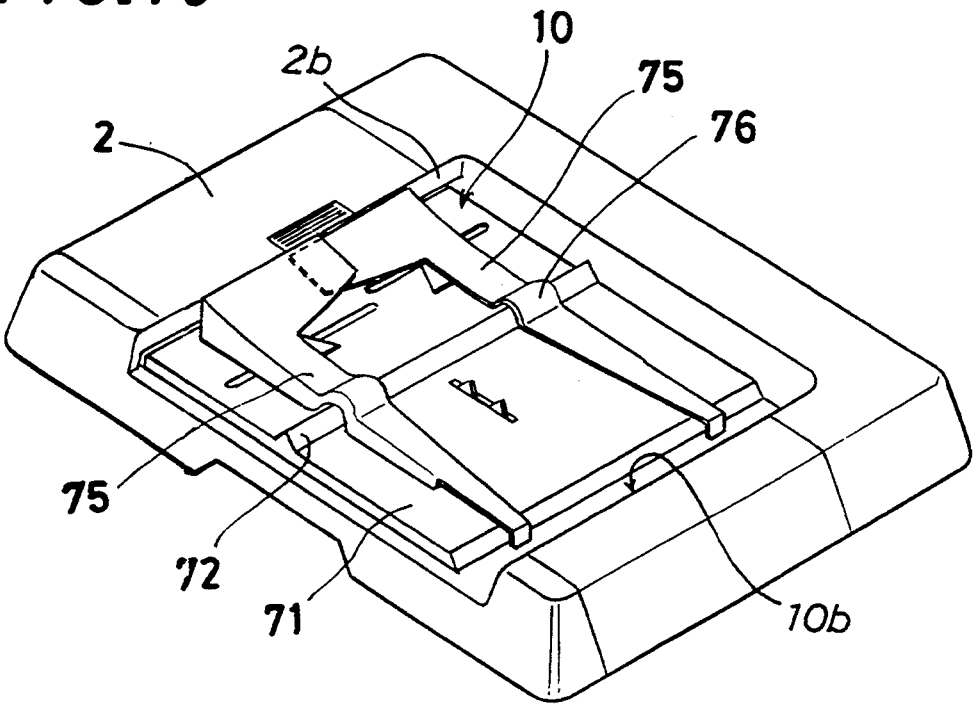
FIG. 10 is a perspective view of a fourth embodiment of this invention.

Also in the fourth embodiment shown in FIG. 10, for the purpose of preventing the document discharged from the discharge port 10*b* from intruding into the intake port 10*a*through between the front wall 2*b* and the front end of the document receiving means, a rising portion 72 extending widthwise is formed on the document tray 71. The opposite portion of each of document supporting members 75 to the rising portion 71 is curved upward to form a convex portion 76. The document which is being discharged from the discharge port 10*b* and moves forward along the upper surfaces of the document supporting members 75 collides with the convex portions 76, so that it does in no way intrude into the document intake port through between the front wall 2b and the front end of the document supporting members 75.

Figure 11:
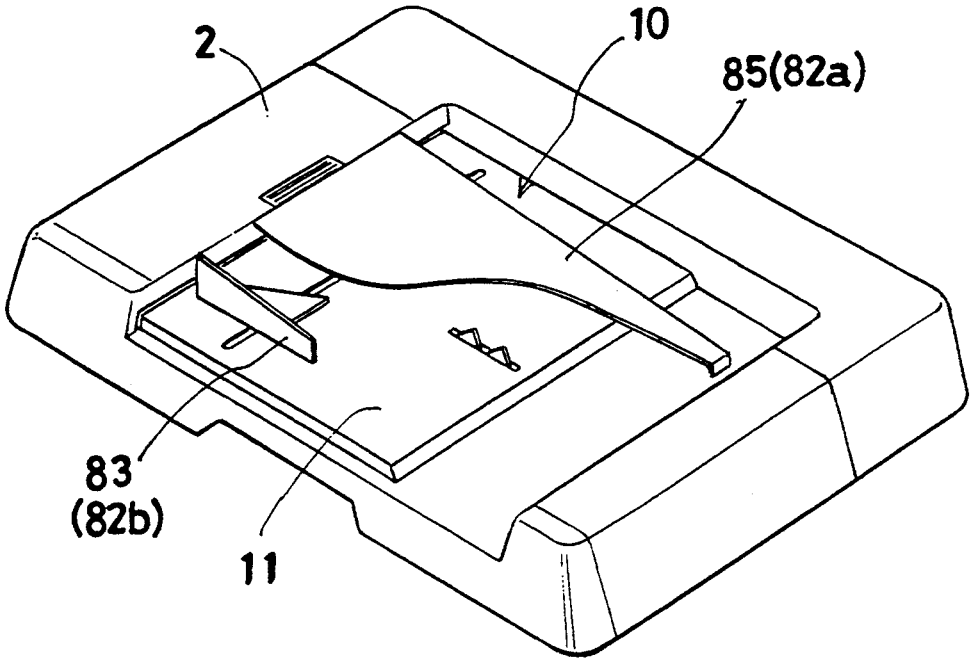
FIG. 11 is a perspective view of a fifth embodiment of this invention.

A modified embodiment shown in FIG. 11 has a first document receiving means 82a composed of a document holding member and document supporting member 85, and a second document receiving means 82b composed of a document holding member 83. This embodiment enjoys an advantage in that the documents to be dealt with can be placed on the document tray 11 with ease.

Figure 12:
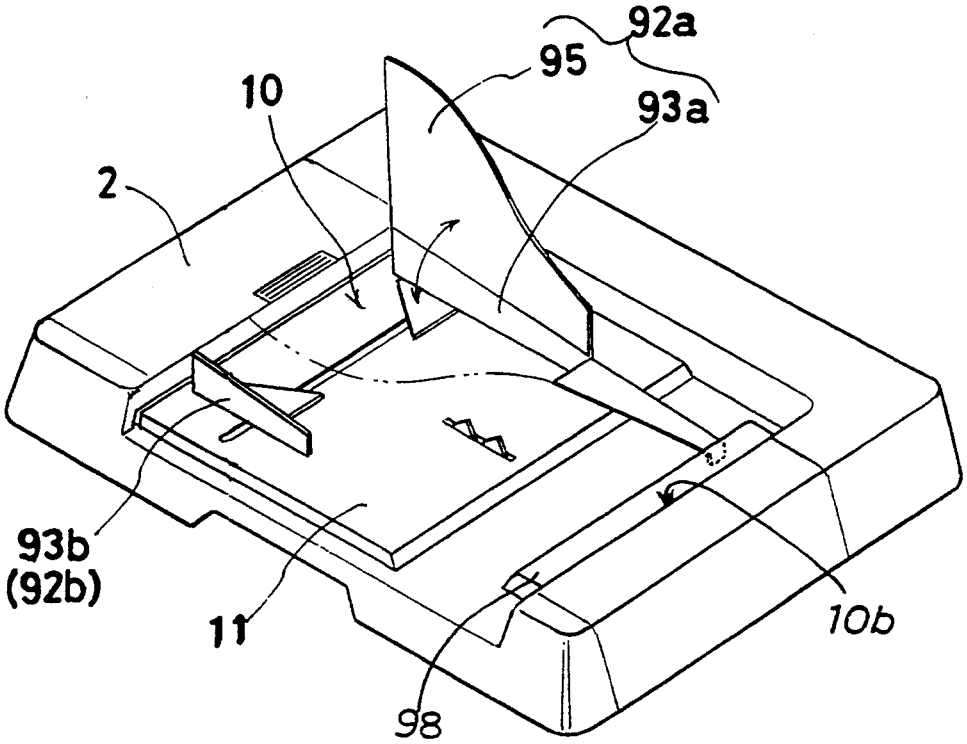
FIG. 12 is a perspective view of a sixth embodiment of this invention.

Also in the embodiment shown in FIG. 12, a document supporting member 95 is disposed only on one document holding member 93a to form a first document receiving means 92a. A second document receiving means 92b is composed of only a document holding member 93a. The document supporting member 95 is hinged on the document holding member 93 so as to be opened upwardly when placing the documents on the document tray 11.

This embodiment has a curing member 98 formed by rising the rear end portion of the document tray 11 in a step shape. This curing member 98 serves to allow the document discharged from the discharge port 10b to be maintained flat horizontally, so as not to cause the leading end of the discharged document to collide with the tail end of the documents stacked on the document tray 11.

As is apparent from the above, the document supporting member may be provided on at least one of the document receiving means, but not necessarily disposed on both the document receiving means. Furthermore, the document supporting member is not limited in shape and may have any other desired shape capable of permitting the given original documents to be easily placed on the document tray and reliably receiving the document sent out from the image reading station defined on the image processing device.

EFFECT OF THE INVENTION

As described in detail above, the present invention provides an automatic document feeder capable of effectively feeding given original documents stacked on a document tray in a document storage portion one by one to the image reading station of an image processing device and discharging the document from the image reading station onto a document receiving means disposed above the document tray, and further placing the discharged documents in the document storage portion independently of the unfed documents stacked on the document tray. Since the document feeder of this invention has a structure in which the document sent out from the image reading station is sent out to the document storage portion including the document tray on which the given documents are stacked, and the document feed and discharge passages are curved in a substantially U-shape, it can be made compact and improved in performance and reliability of transporting the given documents to be dealt with. The document feeder of this invention is provided with at least one guide piece on the document tray and curing member close to a document discharge port, thereby to prevent the document discharged through the discharge port from colliding with the tail end of the stack of documents left on the document tray or coming into the stack of documents. The automatic document feeder of the present invention is advantageously applicable to various image processing devices such as a copying machine, printer, facsimile and image scanner and all sorts of devices to which a sheet material is required to be automatically fed.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is:

1. An automatic document feeder for automatically feeding given original documents one by one to an image reading station of an image processing device and discharging the document from the image reading station, which comprises:

a document tray for placing one or more of said original documents thereon, said document tray being defined by at least one side wall, a front wall and a rear wall;

a document transporting means having a document feeding part located on one end of the document tray for transporting the documents one by one from said document tray to the image reading station, and a document discharging part located on the other end of the document tray for sending out the document from the image reading station; and document receiving means having a pair of document holding members standing upright on said document tray and each having an upper end, and at least one document supporting member extending horizontally from said upper end of at least one of said document holding members;

wherein:

said document holding members are slidably movable width wise in accordance with the original document or documents placed on said document tray;

said document feeding part has a document intake port formed in said front wall of said document tray and a feed passage curved in substantially U-shape, through which the document is fed from said intake port to said image reading station; and said document discharging part has a document discharge port formed in said rear wall of said document tray and a discharge passage curved in substantially U-shape, through which the document is sent out from said image reading station to said document discharging part and discharged onto said document receiving means.

2. An automatic document feeder according to claim 1, wherein both said document holding members each have said document supporting member.

3. An automatic document feeder according to claim 2, wherein said document supporting members each have at least one concave notch so as to define a wide opening between said document supporting members for allowing the documents to pass therethrough.

4. An automatic document feeder according to claim 1, wherein said document supporting member is disposed on one of said document holding members.

5. An automatic document feeder according to claim 1, further comprising a curing member disposed on said document tray close to said discharge port formed in said document discharging part for allowing the document discharged from said discharge port to be maintained flat horizontally.

6. An automatic document feeder according to claim 1, wherein said document supporting members are each formed in a shape tapered off toward said document discharge port.

7. An automatic document feeder according to claim 1, wherein said document supporting members are each formed of a substantially L-shaped plate and partially overlap with each other.

8. An automatic document feeder according to claim 1, wherein said document tray has a rising portion extending widthwise, and said document supporting members each has a corresponding convex portion.

9. An automatic document feeder according to claim 1, wherein said document supporting member is hinged on one of said document holding members so as to be opened upwardly.

10. An automatic document feeder for automatically feeding given original documents one by one to an image reading station of an image processing device and discharging the document from the image reading station, which comprises:

a document tray for placing one or more of said original documents thereon, said document tray being defined by at least one side wall, a front wall and a rear wall;

a document transporting means having a document feeding part located on one end of the document tray for transporting the documents one by one from said document tray to the image reading station, and a document discharging part located on the other end of the document tray for sending out the document from the image reading stations; and document receiving means having a pair of document holding members standing upright on said document tray and each having an upper end, and at least one document supporting member extending horizontally from said upper end of at least one of said document holding members;

wherein:

said document feeding part has a document intake port formed in said front wall of said document tray and a feed passage curved in substantially U-shape, through which the document is fed from said intake port to said image reading station;

said document discharging part has a document discharge port formed in said rear wall of said document tray and a discharge passage curved in substantially U-shape, through which the document is sent out from said image reading station to said document discharging part and discharged onto said document receiving means; and said document tray is provided with at least one guide piece elastically protruding upward in a normal state and retractable when placing the document thereon, said guide piece having a sliding slope facing said document discharge port so as to lead upward the document discharged from said document discharging part when the document discharged collides with said guide piece.

11. An automatic document feeder for automatically feeding given original documents one by one to an image reading station of an image processing device and sending out the document from the image reading station, which comprises:

a housing having a document storage portion defined by at least one side wall, a front wall and a rear wall;

a document tray formed in said document storage portion for placing one or more of said original documents thereon;

a document transporting means disposed within said housing, and including a document feeding part close to one end of the document tray for transporting the documents one by one from said document tray to the image reading station, and a document discharging part close to the other end of the document tray for sending out the document from the image reading station; and document receiving means disposed in said document storage portion, and having a pair of document holding members standing upright on said document tray and each having an upper end, and at least one document supporting member extending horizontally from said upper end of at least one of said document holding members;

wherein:

said document holding members are slidably movable widthwise in accordance with the original document or documents placed on said document tray;

said document feeding part has a document intake port formed in said front wall of said document tray and a feed passage curved in substantially U-shape, through which the document is fed from said intake port to said image reading station; and said document discharging part has a document discharge port formed in said rear wall of said document tray and a discharge passage curved in substantially U-shape, through which the document is sent out from said image reading station to said document discharging part and discharged onto said document receiving means.

12. An automatic document feeder according to claim 11, further comprising a curing member disposed on said document tray close to said discharge port formed in said document discharging part for allowing the document discharged from said discharge port to be maintained flat horizontally.

13. An automatic document feeder for automatically feeding given original documents one an image reading station of an image processing device and sending out the document from the image reading station, which comprises:

a housing having a document storage portion defined by at least one side wall, a front wall and a rear wall;

a document tray formed in said document storage portion for placing one or more of said original documents thereon;

a document transporting means disposed within said housing and including a document feeding part close to one end of the document tray for transporting the documents one by one from said document tray to the image reading station, and a document discharging part close to the other end of the document tray for sending out the document from the image reading station; and document receiving means disposed in said document storage portion, and having a pair of document holding members standing upright on said document tray and each having an upper end, and at least one document supporting member extending horizontally from said upper end of at least one of said document holding members;

wherein:

said document feeding part has a document intake port formed in said front wall of said document tray and a feed passage curved in substantially U-shape, through which the document is fed from said intake port to said image reading station;

said document discharging part has a document discharge port formed in said rear wall of said document tray and a discharge passage curved in substantially U-shape, through which the document is sent out from said image reading station to said document discharging part and discharged onto said document receiving means; and said document tray is provided with at least one guide piece elastically protruding upward in a normal state and retractable when placing the document thereon, said guide piece having a sliding slope facing said document discharge port so as to lead upward the document discharged from said document discharging part when the document discharged collides with said guide piece.

* * * * *